US006286563B1

(12) United States Patent
Camacho et al.

(10) Patent No.: US 6,286,563 B1
(45) Date of Patent: Sep. 11, 2001

(54) AUTOMATIC PAIRING MACHINE FOR AUTOMOTIVE CABLE WITH ELECTRONIC CONTROL AND TORSION METHOD

(75) Inventors: Oscar Suarez Camacho; Florencio Orozco Mosqueda; Alfonso Gomez Espinoza, all of Queretaro (MX)

(73) Assignee: Servicios Condumex S.A. de C.V., Queretaro (MX)

( * ) Notice: Subject to any disclaimer, the term of this patent is extended or adjusted under 35 U.S.C. 154(b) by 0 days.

(21) Appl. No.: 09/460,101

(22) Filed: Dec. 13, 1999

(30) Foreign Application Priority Data

Jun. 29, 1999 (MX) ..... 996133

(51) Int. Cl.[7] ..... B21F 7/00
(52) U.S. Cl. ..... 140/149
(58) Field of Search ..... 140/115, 149

(56) References Cited

U.S. PATENT DOCUMENTS 2,835,283 * 5/1958 Thone et al. ..... 140/149
3,750,720 * 8/1973 Steigerwald ..... 140/149
4,132,250 * 1/1979 Brown et al. ..... 140/149

* cited by examiner

*Primary Examiner*—Lowell A. Larson
(74) *Attorney, Agent, or Firm*—Carmen Pili Curtis

(57) ABSTRACT

An automatic automotive cable braiding or pairing machine that does not require special foundation or anchoring for its mounting where in the design of its arrangements consisting of: clamp operated by a pneumatic or hydraulic actuator; a pneumatic-type pressing device or fastener that permits the torsion of cables in cut segments with constant pitches and operates with different gauges; and a tailstock element with terminal holders system that operates with an actuator; and sensor, protection and control electronic elements; and a torsion method.

24 Claims, 6 Drawing Sheets

AUTOMATIC PAIRING MACHINE FOR AUTOMOTIVE CABLE WITH ELECTRONIC CONTROL AND TORSION METHOD

Several types of torsion machines are known in the art for electric conductor cables, usually defined as laying machine and operate mechanically either through hydraulic mechanisms or pneumatic mechanisms or both. European patent EP 0844 704 AZ describes a method to manufacture paired cables, through torsion machine with subsequent rotation of at least one of its clamping elements in such a way that the aligned wires are twisted together while they are kept under tension. The rotation clamp can be mounted on a shuttle that can be axially moved with regard to the pairing trajectory between the clamps during the rotation.

The functioning of said machine is characterized because it has a tension element placed on a shuttle that moves in the axial direction of the torsion stretch and because said carriage that moves towards the other tension element is controlled through a predetermined force due to the shortening of the distance of the torsion stretch during the pairing operation.

The applicant has developed an automatic automotive cable pairing or braiding machine that does not require foundation or anchoring to the floor for its installation, that is characterized by the design of its clamping elements actuated by a pneumatic actuator and pneumatic press type pressing device that permit the torsion of the cables with terminal applied at least at one end in previously cut segments, with/without applied terminals providing constant pitches and operating at different combinations of gauges and terminals in said cables.

DESCRIPTION OF THE INVENTION

Hereinafter the invention will be described according to the drawings of FIGS. 1 to 4, wherein:

FIG. 1 is a front view of the automatic pairing machine for automotive cables.

FIG. 1*a* is an upper plan view of FIG. 1.

FIG. 1*b* is a right side view of FIG. 1.

FIG. 1*c* is a left side view of FIG. 1.

Figure 5C:
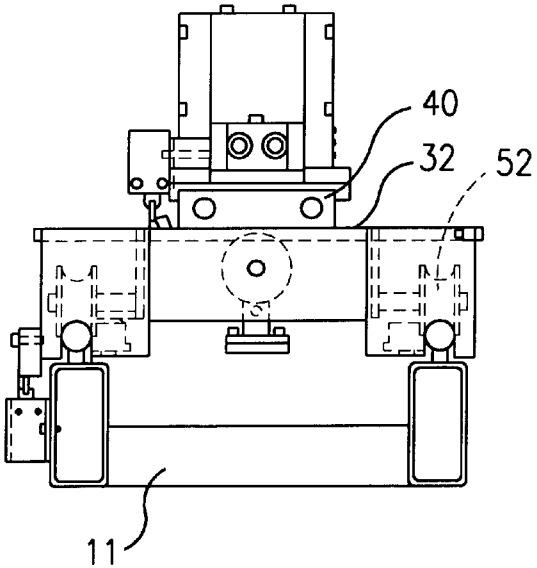
Figure 5B:
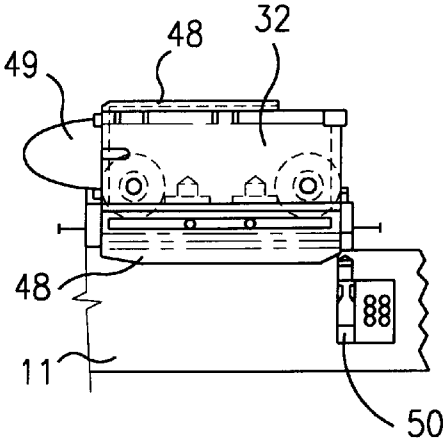
Figure 5A:
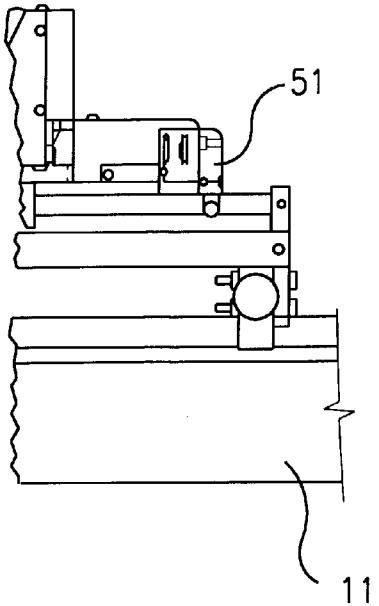

FIG. 5*a* is a view of a section of the tailstock backing.

FIG. 5*b* is a front view of the shuttle. Pressing device support.

FIG. 5*c* is a right side view of the pressing device and tailstock carriage.

Figure 6:
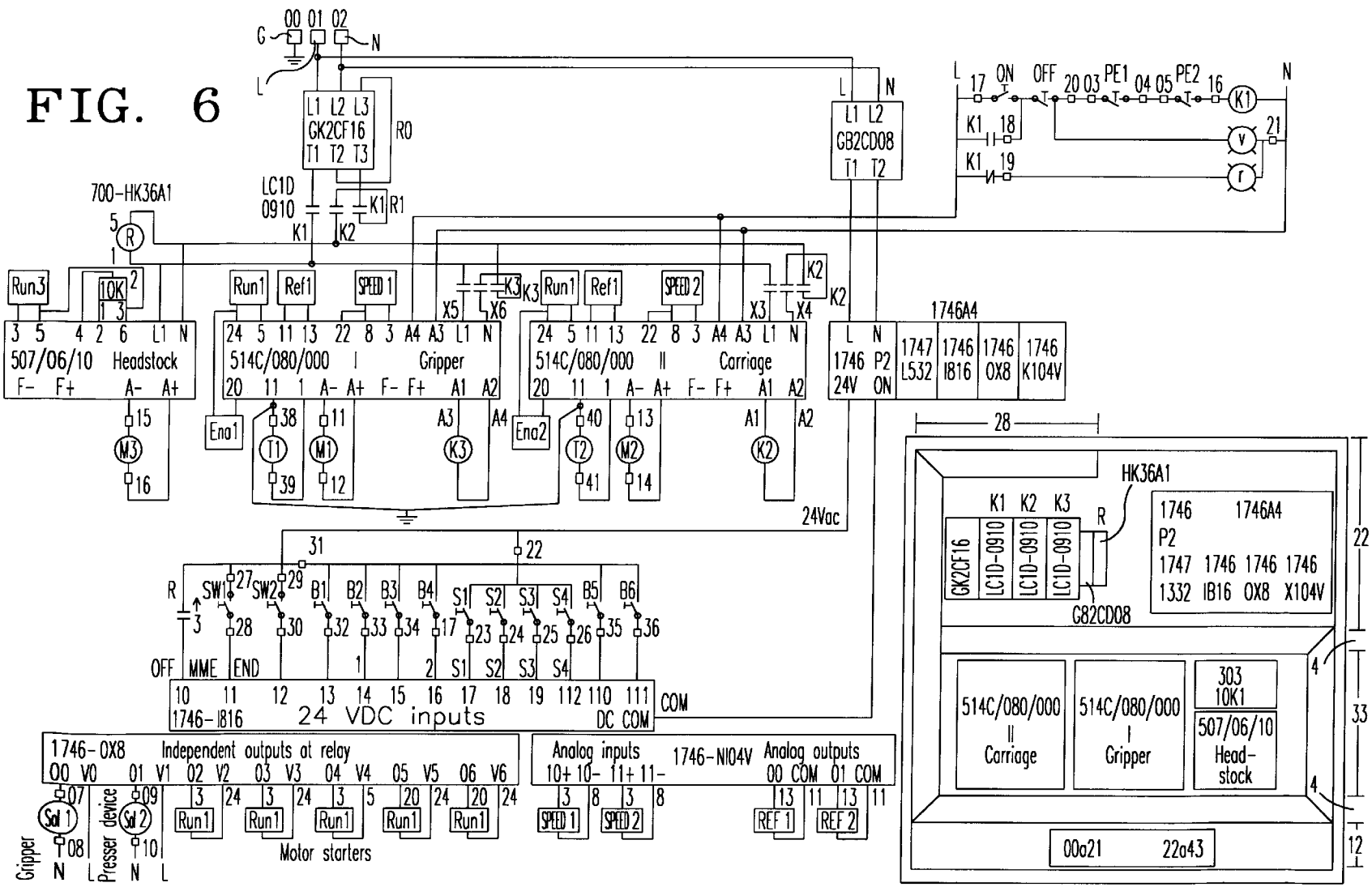

FIG. 6 corresponds to the control and power electric diagram of the pairing machine.

Figure 1A:
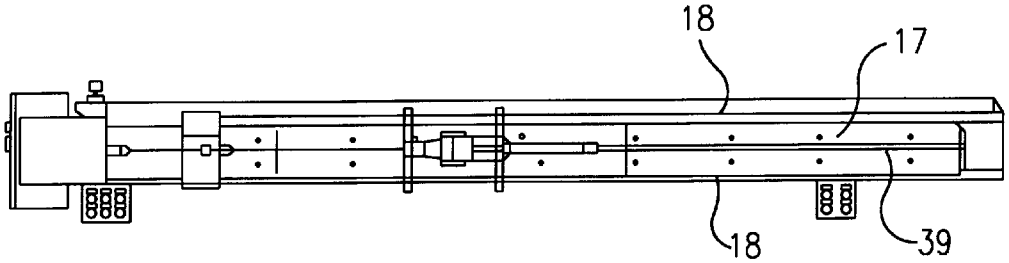
Figure 1:
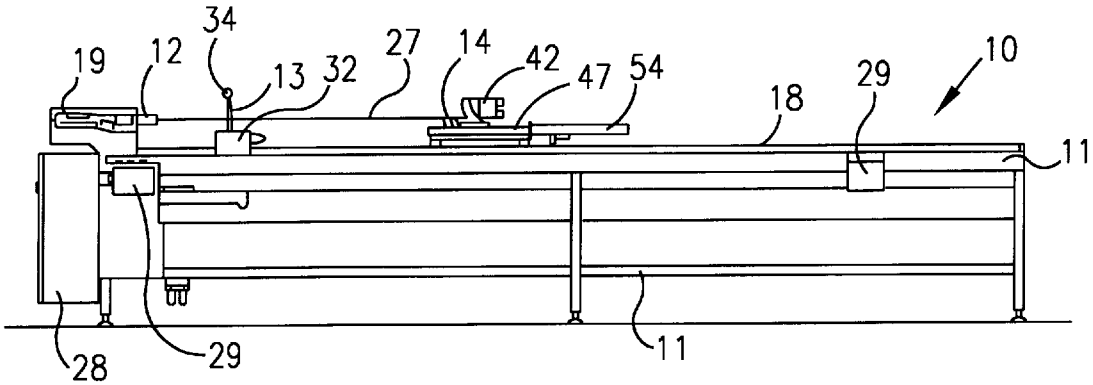

FIG. 1 shows the combination of the main modules of the automatic pairing machine for automotive cable 10, said main elements are:

An elongated bench rigid housing structure 11, consisting of: a rigid frame made of commercial structural profiles capable of supporting the total weight: of all the additional components and providing the machine the necessary stiffness to support the continuous work of the system. On said housing are installed all the main elements and the complementary components that permit the operation of the equipment: air pressure regulators, line and hose tensors, electrovalves, motors, belts, wiring, etc.

In the upper part of the housing 11 there is a metal cover platform 17 as shown in FIG. 1*a* on which a pair of guide bars 18, located symmetrically lengthwise and throughout the cover 17.

Figure 2:
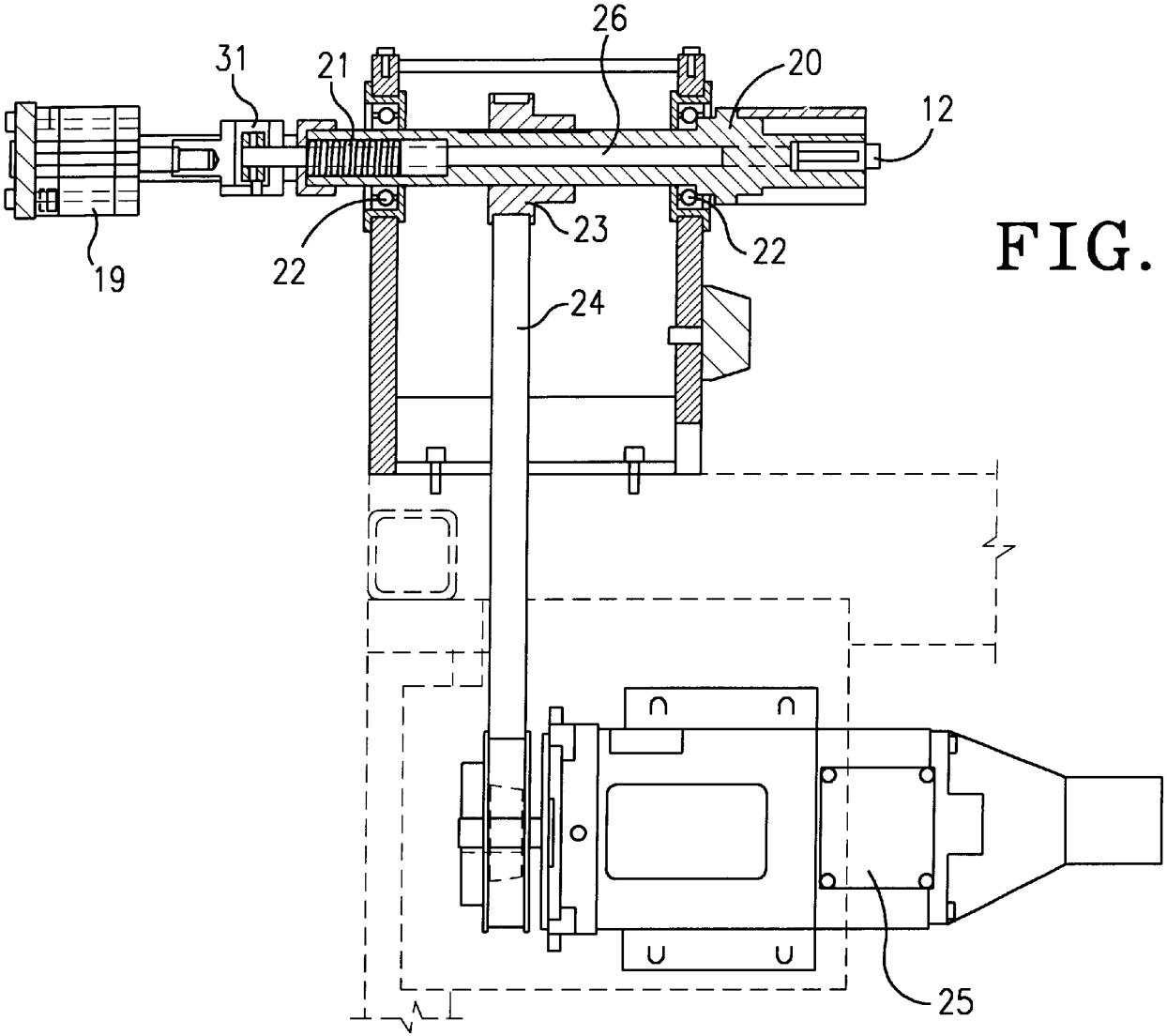
FIG. 2 is a front view with a cross section of a clamp module for cable pairing.

As first modular element, as shown in FIG. 1 located on the left end of the housing platform 17, is a fixed module of clamping element 12. Said element is operated with a clamp actuator 19, and consists of: a hollow shaft 20 FIG. 2, shown in that accommodates the clamp mechanism. The clamping element is actuated for closing through an internal (adjustable) spring 21 the actuator 19 opens the clamping element by pneumatic, hydraulic or electrical means. The actuator 19 is axially assembled on the hollow shaft 20 through an opening coupling. The hollow shaft 20 is mounted on two bearings 22 which is actuated in turn through a set of pulleys 23, a synchronized, flat or trapezoidal belt 24, a clamp motor 25, for movement transmission and an actuator axle 26 located in the center of the hollow shaft.

Figure 1C:
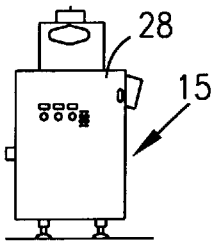
Figure 1D:
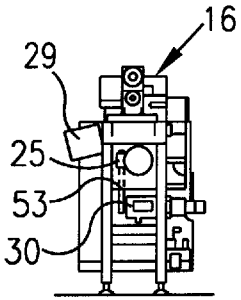

The main function is to fasten the ends of the cable to be paired 27 FIG. 1, said cable with or without terminals, and then to apply the necessary torsions to cause the pairing. The pitch of the pairing varies according to the speed of the clamping element. As shown in FIG. 1*c*, on the left side cover 15 is an electric control element panel 28. On FIG. 1*b*, the right side of the cover 16 is an electric bottom panel 29 and a shuttle motor 30, for providing longitudinal movements to a shuttle 32 located on the platform 17.

Figure 3:
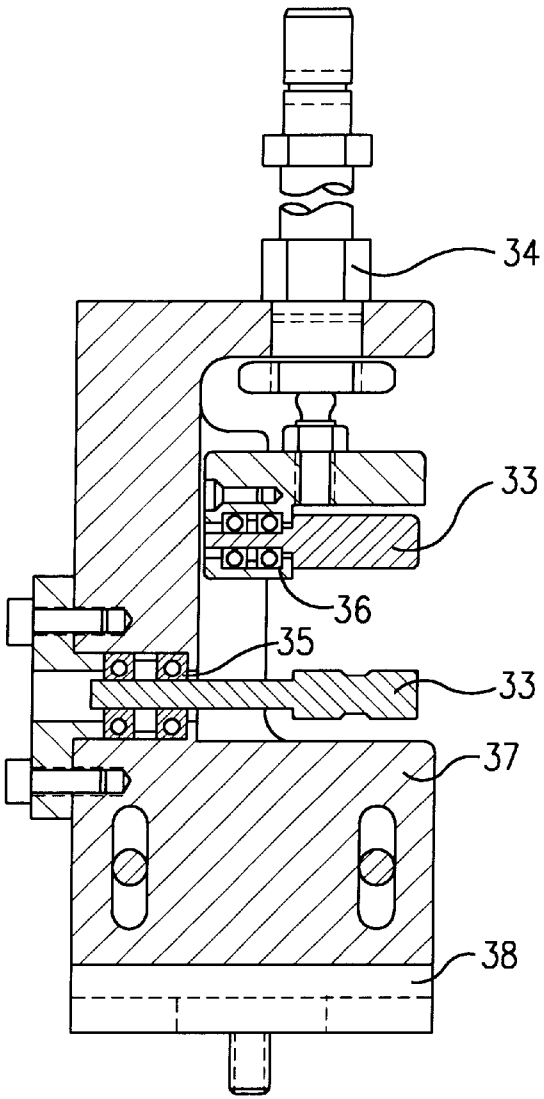
FIG. 3 is a front view with vertical longitudinal section of a pressing module for cable pairing.

As second modular element located on the platform 17 and placed between the clamp 12 and the tailstock 14, is a pressing module 13, with dynamic longitudinal movement on the guide bars 18 through the shuttle 32. The pressing module 13 element consists of a type C structure with a main frame 37, supported on an adjustable base 38, where the following are accommodated: a set of rolls 33, as shown FIG. 3, that is actuated by a pneumatic actuator 34. The set of rolls catch and fasten between them the pair of cables 27 to be paired as shown in FIG. 1*a*. It has two main functions: first, to maintain the cables parallel immediately before pairing and second to avoid that the torsions applied by the clamp reach the tailstock module 14, shown in FIG. 1, concentrating the torsion only on the interval existing between the clamp module and the pressing element. The pair of rolls 33 are displaced through their bearing elements 35 and 36.

As mentioned above, the purpose of the shuttle 32 is to provide longitudinal movement to the pressing module, and thus the shuttle movement must be conducted in coordination with the revolutions of the clamp. From the relation of these modules depends the pairing pitch. The shuttle always has a constant speed, in such a way that if the pairing pitch varies, what really varies are the RPM's of the clamp.

The pressing module is mounted on the shuttle 32, FIG. 5*b* that has wheels 52 FIG. 5*c* that move along the guide bars 18, located in the upper part of the housing 11 FIG. 1 and is actuated by a motor 30 and set of dented pulleys, 53, FIG. 1*b* that provide movement to the carriage or shuttle through a continuous timing belt 39.

The shuttle has two basic positions: home position (HOME) which is located next to the clamp 12 and end position (END) which will always be determined by the final position of the tailstock 14 after pairing the cable.

Both positions are determined by cams to actuate the microswitches. In the upper part of shuttle 32, there is a cam 48 FIG. 5*b* that actuates the END microswitch position. In the back part thereof there is a cam 48 FIG. 5*b* that actuates the electric element of HOME microswitch sensor 50 FIG. 5*b*. At the front of the shuttle there is a rubber bumper 49. As third main modular element located on said platform 17 and placed on the opposite end of the clamp, there is a tailstock module (end system) 14 FIGS. 1 and 4 with longitudinal movement along the guide bars 18.

Figure 4:
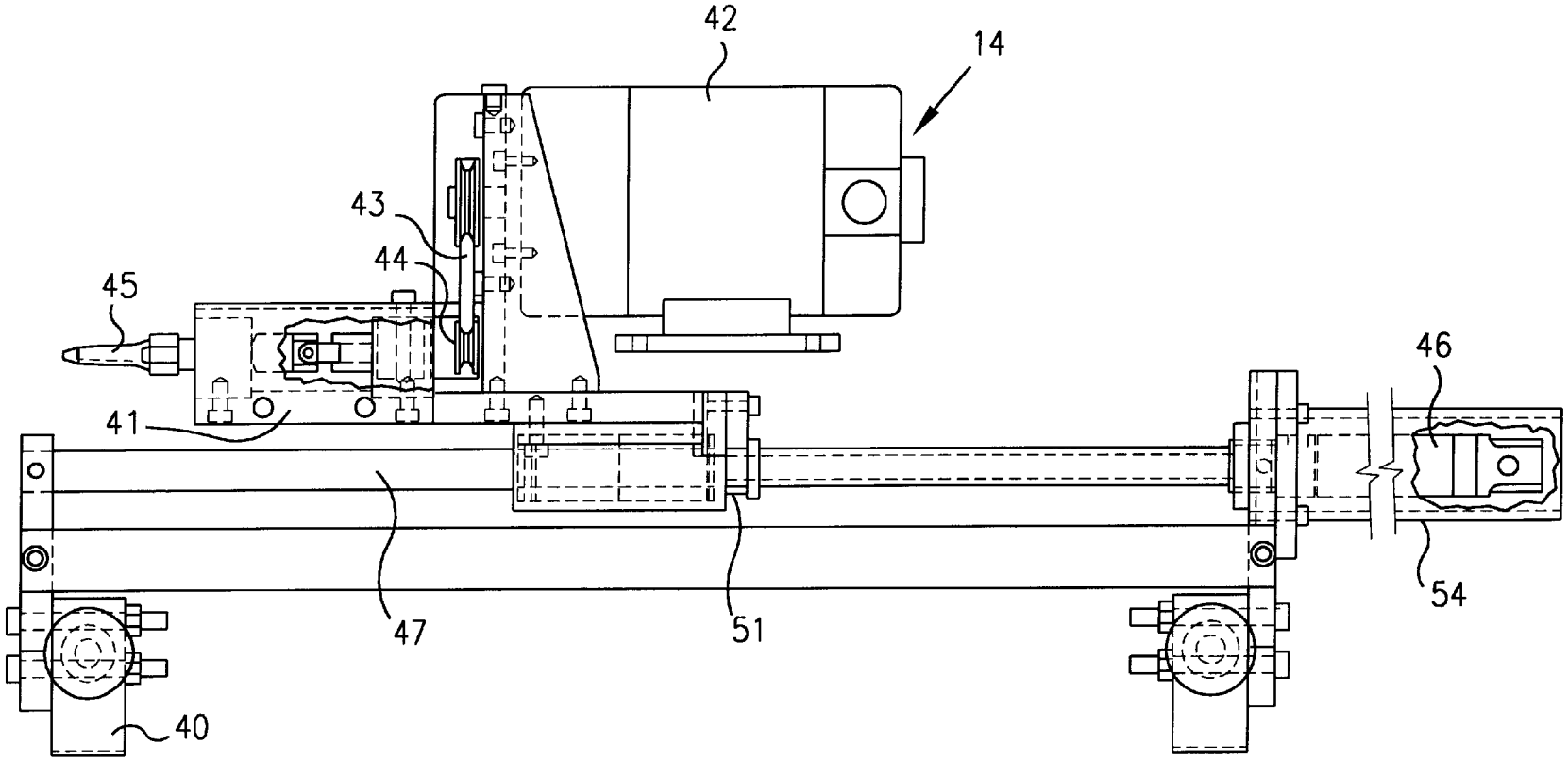
FIG. 4 is a front view with cross section of the tailstock module or end pairing system.

The tailstock module is a dynamic arrangement with an "L" type structure 40 FIG. 4, fastened to a dragging plate 51, and a track 41 with slides 47, that moves longitudinally along platform 17. In said structure a motor 42 FIG. 4 is integrated in its upper end to transmit the movement on a belt 43 to the system of terminal holders 45 through a pulley arrangement 44. In the opposite end of the terminal holders 45 is a pneumatic actuator device 46, and externally an end of run (END) sensor microswitch element 51, shown in FIG. 5*a*.

This module is the only arrangement adjustable in any position along platform 17. The tailstock is a very important operative design during the pairing process, and carries out several functions during the pairing operation. First, it must fasten one of the cable terminals, then during the pairing, it must individually compensate on each end the torsions generated by the clamp; and finally, through a pneumatic actuator, two additional functions are performed: keeping the cables under constant tension and compensating for the shrinking of the cables as a result or the pairing step.

The main motor 42 induces movement to two universal joints through a triangular pulley arrangement. Each one of the universal joints has an interchangeable terminal holders mounted outwardly and in converging arrangement within which the different types of terminals are inserted.

With regard to the tension exerted by the tailstock, said tension can be adjusted through a pressure regulator located on the protective cover 54 FIG. 4 of the pneumatic actuator 46.

As additional elements, the following devices can be mentioned:

Control and power electric panel 15 shown in FIG. 1*c*

The control and power panel contains the elements necessary to conduct the control of the process and the electric protection of the components of the pairing machine. Hereinafter the electric components of the panel are described as well as their function in the working of the equipment, according to the electric diagram of FIG. 6.

Protection Elements

"GK2CF16" switch, with thermal and magnetic protections for power feeding to the speed drivers.

"GB2CD08" switch, with thermal and magnetic protection for control circuit feeding.

"K1" LC1D0910 contactor, used to cut the energy supply to the speed drivers.

"K2" LC1D0910 contactor, used to supply energy to the carriage speed drivers.

"K3" LC1D0910 contactor, used to supply energy to the clamp speed drivers.

"R" 700-HK36A1 control relay, used to indicate to the PLC, the presence of energy in the drivers.

Control Elements

"PLC" integrated by 1746a4, 1746P2, 1747L532, 17461B16, 1746OX8 and 1746NIO4B codes. The purpose of this equipment is to carry out the tasks necessary to control the process, to connect pneumatic and electric components and to coordinate the speed ratio of the shuttle and the clamp.

"I" 514C speed drivers to control the clamp movement.

"I" 514C speed drivers to control the carriage movement.

"507" 507/06/10 speed drivers to control the tailstock movement.

"30310K1" 10K Ω, a potentiometer is used to adjust the tailstock speed.

On the panel main door the dialog elements are to be found. A red lit push button (de-energize system), a green lit push button (Energize system), and a four position selector (Pairing pitch).

As shown in FIG. 6, energy flows from the source through a circuit protector, GB2CD08, to the control circuit. Energy also flows from the source to the drivers through a protector, GK2CF16 and "K1" LC1D0910 contactor which is used to cut energy supply from the source. Prior to reaching the drivers, contactors "K2" and "K3" are used to cut off energy to the carriage and clamp drivers, respectively as desired. Energy flows from the source to the tailstock driver through the protector, GK2CF16 and K1 contactor. A potentiometer "30310K1", 10KΩ is hooked to the tailstock driver to control the speed of the tailstock driver. A relay "R" 700-HK36A1 is used between "K1" and the ground to see if energy is present in the drivers.---.

Dialogue Switches (Buttons) 16

They are located on the front side of the machine. The first of them is on the left (fixed) and the second is on the right side (adjustable). They include 6 and 4 pulsators, respectively, with the following legends and functions:

Emergency Stop With Interlocking (Red)

On pressing said button, the machine totally stops the task it is currently performing. Once pressed, it is necessary to take it back to its initial position before reestablishing the system (interlocking release). Afterwards, the system is rehabilitated from the main panel wth ENERGIZE SYSTEM.

Initiate Cycle

On pressing said button, the pairing sequences are started if and only if the correct steps and sequences have been followed.

Return Shuttle

This button fulfils two main functions:

First: during the machine preparation, when after the pressing device has been lowered it is desired to raise it again to release the cables.

Second: during the pairing cycle or once said cycle is over, by pushing the button the shuttle returns to the starting position. It is to be mentioned that if the shuttle is returned while the cycle is being performed, the system response will be to stop the pairing rotation, return the shuttle to the starting position arid open the clamp to release the ends.

Open Clamp:

During the preparation, it is used to open the clamp if a wrong mounting of the ends occurs. If the pressing device has already been lowered, on pushing this button, the pressing device is first released and then the clamp.

Close Clamp

This button permits to close the clamp during the preparation of the machine.

Lower Pressing Device

On pushing this button the pressing device is lowered during machine preparation.

Elements that have to be adjusted to establish the operations conditions are also included such as:

HOME Position Microswitch 50 FIG. 5B.

This element determines shuttle stop during its return to the initial position. It has only one freedom degree (upwards-downwards) and must be adjusted to permit a soft actuation with the cam to be found in the shuttle.

HOME Microswitch Cam 48 FIG. 5*b*.

This cam is in the back part of the shuttle. It has only one longitudinal freedom degree. From its adjustment position depends the final position of the shuttle at the HOME end. A cam adjustment totally to the right stops the shuttle before contacting the clamp bumper. A cam adjustment totally to the left will propitiate a late stop of the shuttle.

END Position Microswitch 51 FIG. 5*a*.

This element is located on the right side of the tailstock. It is operated by the cam located on the upper part of the shuttle and from its operation depends the total stoppage of the clamp and tailstock motors. It has only one freedom degree (upwards-downwards) and must be adjusted to permit a smooth operation of the cam.

END Microswitch Cam 48 FIG. 5*b*.

It is located in the upper part of the shuttle. It must be aligned in order to insure the correct operation of END micro. Its adjustment determines the anticipated or late stop of the shuttle and tailstock. An adjustment totally to the right determines an anticipated stop of the motors, obtaining a length without pairing larger than the specified one. An adjustment totally to the left determines a late stop of the motors, with a closure of the pairing pitch or an excessive torsion of the cable terminals in the tailstock.

Tailstock Potentiometer.

It is located within the electric panel in the upper part of the driver 507/06/10 and serves to control the tailstock revolutions. The potentiometer shows a scale from 0 to 100, with a speed range from 0 (0) to 1700 (100) RPM's. A very high adjustment in the potentiometer eliminates torsions by the clamp, affecting directly the pitch. A very low adjustment closes the pitch in the tailstock.

Tailstock Base.

It is a rigid frame on which the tailstock slides to compensate for the shrinking of the paired cable. Through 4 threaded knobs it is possible to fasten the operation position for this base, on the guide bars. Depending on its adjustment position, the tailstock will absorb or not the total shrinking of the cable.

The shrinking of the cable depends on the initial gauge and pairing pitch. The shrinking must be determined experimentally for each particular case and, based on this, the position of the base at the start is determined.

Indicator Ring.

On one of the guides of the tailstock base there is an indicator ring. This element is used to establish its adjustment conditions. For each cable installed and tense on the machine, this ring will move towards the right till it contacts the linear bearing of the tailstock. During the pairing, the ring is moved by the bearing as a result of the shrinking. At the end of the pairing cycle the tailstock can return to the back part of the guides (manual pull) but the ring will keep registering the maximun shrinking position of the cable. In this way, with a simple subtraction between the initial position and the final position of the ring it is possible to determine the real shrinking of the cable and predetermine the minimum stroke required.

Tension Regulator.

It is a pneumatic pressure regulator located on the protective cover 54 FIG. 4 of the pneumatic actuator of the tailstock and its purpose is to regulate the tension to be applied on the cables.

Interchangeable Terminal Holders.

They are a pair of grooved and interchangeable ends that must be fitted on the tailstock. Based on the terminal type and wire gauge, the most appropriate set is installed for the operation.

Scale.

It is to be used as reference for the position of the tailstock base and to register initial length and shrinking data.

Torsion Method

1. The process begins with the shuttle located at the far left of the machine and operating the HOME microswitch 50 FIG. 5*b*, with both the clamp and the pressing device in an open position.
2. Place the pair of cables on the pairing machine beginning always by the extreme of the tailstock. The cable terminals are inserted, one at a time, in each terminal holders. The parallelism of the cables is maintained, leading them till the end of the clamp.
3. Keeping both cables tense and aligned, the ends are inserted with or without terminal between the clamps and are aligned on the longitudinal grooves located on the inner faces. If necessary, position manually the clamp in such a way that the ends are installed and can be observed clearly. When it is ready, operate the push button CLOSE CLAMP.
4. In case of a faulty insertion, fasten both ends, operate the OPEN CLAMP push button, and repeat the previous step till the preparation is successful.
5. Press the push button LOWER PRESSING DEVICE, and check that both cables are tensed through the effect of the tailstock movement and check that said cables are trapped within the groove formed by the rolls. In the case of a bad fastening with the pressing device, press RETURN shuttle to raise the pressing device and/or release the tension, repeat the operation.
6. Press the push button INITIATE CYCLE. At this moment the clamp and the terminal holders will start to rotate simultaneously, and the shuttle will begin to move towards the right. The clamp will rotate clockwise, while the terminal holders will rotate counterclockwise. If, when operating INITIATE CYCLE, the pressing device had not been previously lowered, the system is programmed to carry out this instruction automatically before initiating the pairing cycle.
7. When the shuttle reaches the end of the tailstock, the END micro must be operated and all the motors stopped. A second later the pressing device will be automatically released and then the clamp. Thus, the release of the ends by the clamp is automatic.
8. The other extremes of the cable are removed from the tailstock and the push button RETURN shuttle is pressed. At this time the shuttle will return to the start position and is ready for a new cycle.

Special Conditions

9. In case of minor error or problem during the operation, the push button RETURN shuttle can be pressed. At this time, all the motors will be stopped, the pressing device will automatically open and the return of the shuttle will start; on arriving at the starting point (HOME), the clamp will automatically open and the cables will be released.
10. In case of accident, press EMERGENCY STOP. The whole movement system stops operating immediately, but both the clamp and the pressing device are closed. When the system is restarted (releasing the stop interlocking), the system returns to the shuttle return routine, i.e. opens the pressing device and moves the shuttle to the HOME position. On arriving at the HOME position, the clamp opens automatically.

The above described invention is considered a novelty and its scope is limited only by the following claims.

We claim:

1. An electrically controlled automatic pairing machine for automotive cable, comprising:

an elongated rigid bench housing having a metal cover platform, the platform having a left end and a right end, a pair of guide bars between the left end and the right end, the left end having an electric control panel, the right end having an electric bottom panel, and a shuttle motor, the shuttle motor providing longitudinal movement along the pair of guide bars to a shuttle located on the platform;

a first module on a left end of the housing having a hollow shaft accommodating a revolving clamping element operated by an actuator for fastening an end of a pair of cables and for applying torsion to cause pairing;

a second pressing module on the platform located between the clamping element and a tailstock, the pressing module having longitudinal movement along the pair of guide bars through the shuttle for maintaining parallelism of the pair of cable immediately before pairing and for protecting the tailstock from the applied torsion of the clamping element, keeping the torsion between the clamping element and the pressing module; and, a third module adjustable in any position along the platform, located opposite the clamping element on the same platform, comprising the tailstock, an electromechanical arrangement of a system of converging terminals, having terminal holders longitudinally moving along the pair of guide bars for fastening an opposite end of the pair of cables, individually compensating the torsion generated by the clamping element and, through a pneumatic actuator, keep the pair of cables under constant torsion and compensate for shrinking of the cables during the pairing process.

2. The pairing machine of claim 1 wherein the guide bars are located symmetrically lengthwise throughout the platform.

3. The pairing machine of claim 1 wherein the actuator is axially assembled on the hollow shaft through an opening coupling.

4. The pairing machine of claim 1 wherein the actuator closes the clamping element through an internal adjustable spring and opens the clamping element by pneumatic, hydraulic or electrical means.

5. The pairing machine of claim 1 wherein the hollow shaft is mounted on two bearings actuated by a set of pulley, a synchronized flat trapezoidal belt and a clamp motor for movement transmission.

6. The pairing machine of claim 1 further comprising an actuator axle on a center of the hollow shaft.

7. The pairing machine of claim 1 wherein the revolving speed of the clamping element and movement of the shuttle determines a pairing pitch of the cable.

8. The pairing machine of claim 1 wherein the pressing module is a C type structure with a main frame supported on an adjustable base, the base having a set of rolls displaced through a bearing and actuated by a pneumatic actuator for catching and fastening the pair of cables between them.

9. The pairing machine of claim 1 wherein the pressing module is mounted on the shuttle, the shuttle having wheels that move along the guide bars and actuated by the motor and a set of dented pulley to provide movement of the shuttle through a continuous timing belt.

10. The pairing machine of claim 1 wherein the shuttle has two basic positions, a home position next to the clamping element and an end positioned determined by a final position of the tailstock, both positions controlled by cams, a cam on an upper part of the shuttle to activate an end microswitch position and a cam at a back part of the shuttle to activate an electric element of a home microswitch sensor.

11. The pairing machine of claim 1 wherein the shuttle has a rubber bumper on a front of the shuttle.

12. The pairing machine of claim 1 wherein the tailstock has an L type structure fastened to a dragging plate on a track with slides that moves longitudinally along the platform.

13. The pairing machine of claim 1 wherein the tailstock has on an end opposite the terminal holders, a pneumatic actuator and an end run microswitch sensor.

14. The pairing machine of claim 1 wherein a inotor on an upper end of the tailstock transmit movement to the terminal holders through a pulley arrangement on a belt.

15. The pairing machine of claim 14 wherein the motor induces movement to two universal joints through a triangular pulley arrangement.

16. The pairing machine of claim 15 wherein the universal joints have interchangeable terminal holders mounted outwardly and in converging arrangement where different types of terminals are inserted.

17. The pairing machine of claim 1 wherein a pressure regulator adjusts the tension exerted by the tailstock.

18. The pairing machine of claim 1 wherein the electric control panel provides a process for controlling the movements and the electric protection of the shuttle, the clamping element, and the tailstock.

19. The pairing machine of claim 1 wherein the electric control panel has a right end and a left end, the right end containing dialogue switches including 6 pulsators, the left end having 4 pulsators, the pulsators used for operating and stopping the shuttle, the clamping element, and the tailstock.

20. The pairing machine of claim 1 wherein the terminal holders have a pair of grooved and interchangeable ends that must be fitted on the tailstock.

21. The pairing machine of claim 1 further comprising a rigid frame on the third module on which the tailstock slides to compensate for the shrinking of the paired cables.

22. The pairing machine of claim 1 further comprising a tailstock potentiometer to control the tailstock revolutions.

23. The pairing machine of claim 1 further comprising an indicator ring for constantly registering the maximum shrinking position of the cable.

24. A method of torsion for automotive cables in a braiding or pairing machine described in claim 1, comprising the steps of:

placing a shuttle at the left end of the pairing machine and actuating a HOME microswitch with a clamp and pressing device in an open position;

placing and fitting a pair of cables in the pairing machine from a tailstock and inserting one cable terminal in each terminal holder, leading each cable till an end of the clamp;

aligning ends of the cables on grooves on the inner faces of the clamp and actuating a push button CLOSE CLAMP after checking for correct insertion;

pushing a LOWER PRESSING DEVICE button and checking for fastening within the grooves or passage formed by a set of rolls;

pressing an INITIATE CYCLE press button to begin the simultaneous rotation of the clamp and terminal holders, the clamp rotating in opposite sense relative to the tailstock and to initiate movement of the shuttle towards the right;

actuating an END microswitch and stopping all motors when the shuttle coincides with the tailstock which at an instant later automatically releases the pressing device and the clamp;

removing the paired cables from a side of the tailstock; and pressing RETURN shuttle to return the shuttle in its starting position thereby making the machine available for another pairing cycle.

* * * * *